US008240890B2

(12) United States Patent
Tsai

(10) Patent No.: US 8,240,890 B2
(45) Date of Patent: Aug. 14, 2012

(54) LAMP HOLDER

(75) Inventor: Ping-Jung Tsai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 99 days.

(21) Appl. No.: 12/915,000

(22) Filed: Oct. 28, 2010

(65) Prior Publication Data

US 2012/0044706 A1 Feb. 23, 2012

(30) Foreign Application Priority Data

Aug. 17, 2010 (TW) ..... 99127377 A

(51) Int. Cl.
*H01R 33/00* (2006.01)
*H01K 1/42* (2006.01)

(52) U.S. Cl. ..... 362/382; 439/619; 439/832; 362/457; 362/647

(58) Field of Classification Search ..... 362/382, 362/457, 647; 439/619, 699.2, 831, 832, 439/833

See application file for complete search history.

(56) References Cited

U.S. PATENT DOCUMENTS

| | | | | |
|---|---|---|---|---|
| 7,025,634 | B1 * | 4/2006 | Swantner et al. | 439/619 |
| 2006/0109663 | A1 * | 5/2006 | Choi | 362/382 |
| 2009/0257226 | A1 * | 10/2009 | Liu et al. | 362/249.02 |
| 2010/0317212 | A1 * | 12/2010 | Daily | 439/230 |

* cited by examiner

*Primary Examiner* — Ali Alavi
(74) *Attorney, Agent, or Firm* — Altis Law Group, Inc.

(57) ABSTRACT

A lamp holder includes a holder body. The holder body includes a first surface, a second surface opposite to the first surface, and a first side surface and a second side surface arranged between the first surface and the second surface. The holder body defines a first groove and a second groove at the first side surface of the holder body. The first groove and the second groove communicate with the first and second surfaces of the holder body. The first groove and the second groove are configured for receiving connectors of a lamp. A fool-proofing member is arranged at a first bottom surface of the first groove.

17 Claims, 6 Drawing Sheets

LAMP HOLDER

BACKGROUND

1. Technical Field

The present disclosure generally relates to a lamp holder, and more particularly to a lamp holder with a fool-proofing capability.

2. Discussion of Related Art

Light emitting diodes (LEDs) are one kind of semiconductor element. Nowadays, LEDs are extensively used as light sources for illuminating apparatuses, due to their high luminous efficiency, low power consumption and long work life.

Conventional LED lamp holder is configured for supporting a lamp (i.e., an LED tube) by two grooves thereof, whereby the lamp can electrically connected to an external power source by the lamp holder. The grooves are similar to each other and easily mixed up. When the lamp is assembled to the lamp holder by wrongly inserting the connectors of the lamp into the grooves, the lamp cannot work and the lamp needs to be assembled with the lamp holder again. Such manipulation is time consuming and laborious, which results in a low assembling efficiency.

Therefore, what is needed is an LED lamp which can overcome the above described shortcomings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION OF EMBODIMENTS

Figure 1:
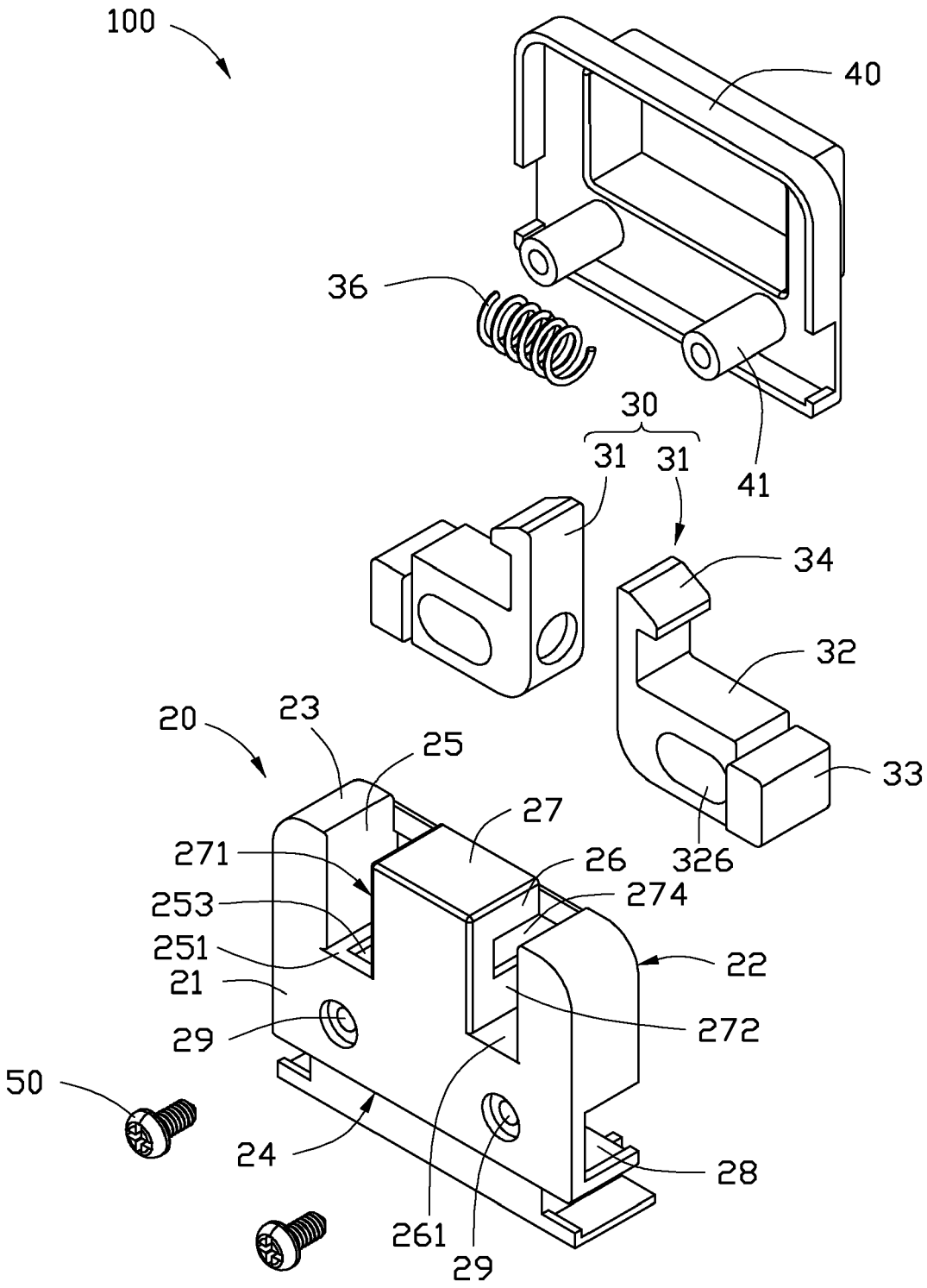
FIG. 1 is an exploded view of a lamp holder in accordance with a first embodiment of the present disclosure.
Figure 2:
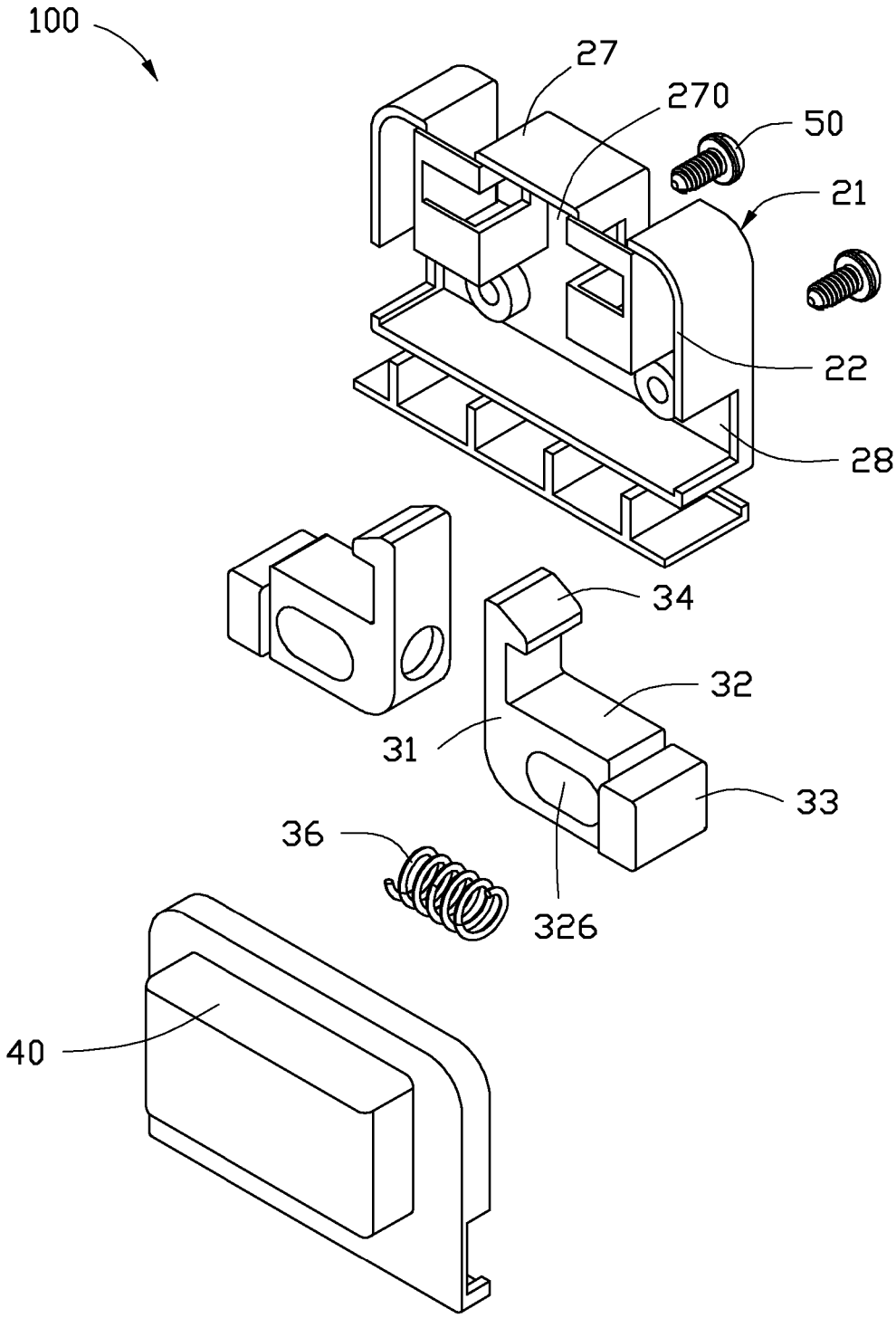
FIG. 2 is an inverted view of the lamp holder of FIG. 1.
Figure 3:
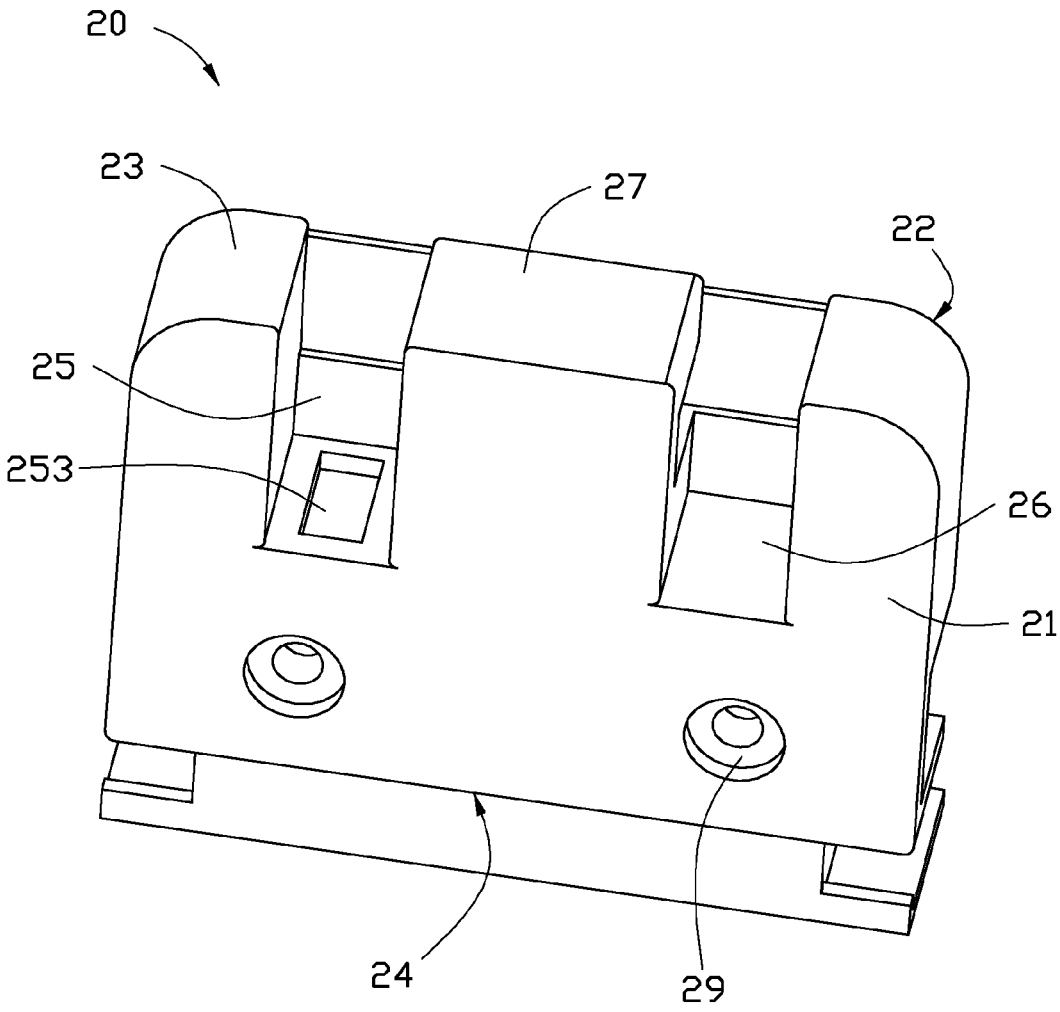
FIG. 3 is an assembled view of the lamp holder of FIG. 1.
Figure 4:
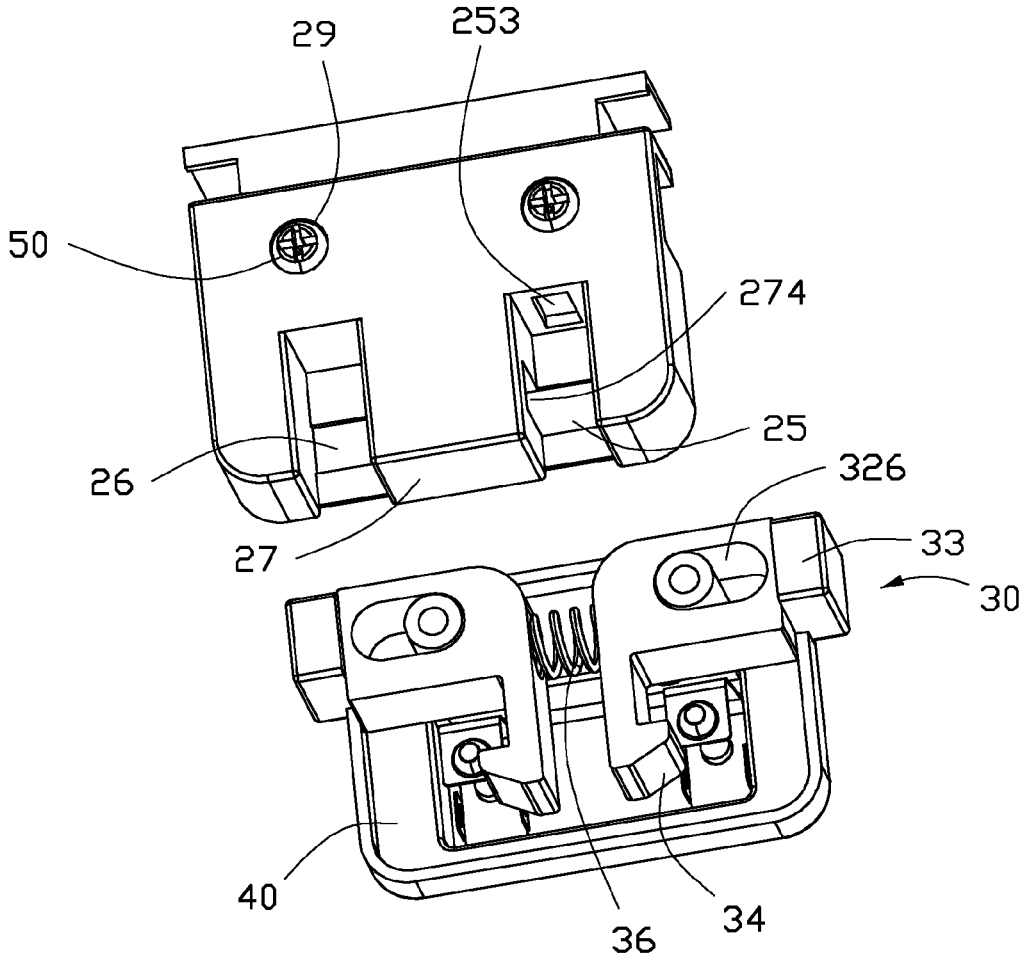
FIG. 4 is a partly assembled view of the lamp holder of FIG. 1.

Reference will now be made to the drawings to describe various embodiments of the present lamp holder in detail.

Referring to FIGS. 1-4, a lamp holder 100, in accordance with a first embodiment, includes a holder body 20, a moving part 30 and a cover 40.

The holder body 20 includes a first surface 21, a second surface 22 opposite to the first surface 21, and a first side surface 23 and a second side surface 24 arranged between the first surface 21 and the second surface 22. The holder body 20 defines a first groove 25 and a second groove 26 recessed downwardly from the first side surface 23. The first groove 25 and the second groove 26 communicate with the first surface 21 and the second surface 22 of the holder body 20. In the present embodiment, each of the first groove 25 and the second groove 26 has a rectangle-shape with a same depth.

The holder body 20 defines a projection 27 between the first groove 25 and the second groove 26. In the present embodiment, the projection 27 defines a recess 270 at the second surface 22 of the holder body 20. The holder body 20 defines a guide way 28 at the second surface 22, and the guide way 28 extends to the first side surface 23. The recess 270 communicates with the guide way 28. The guide way 28 passes through two end portions (not labeled) of the holder body 20, and is adjacent to the first groove 25 and the second groove 26 but not in communication with each other.

The first groove 25 has a bottom surface 251 and the second groove 26 has a bottom surface 261. The first bottom surface 251 of the first groove 25 has a fool-proofing member 253. In the present embodiment, the fool-proofing member 253 is a through hole communicates the first groove 25 with the guide way 28. The through hole extends through the first bottom surface 251.

The holder body 20 defines two screw holes 29 at the first surface 21. The screw holes 29 extend to the second surface 22 of the holder body 20 and communicate with the guide way 28.

The projection 27 of the holder body 20 includes a first side surface 271 adjacent to the first groove 25, and a second side surface 272 adjacent to the second groove 26. In the present embodiment, the projection 27 defines two holes 274 at the first side surface 271 and the second side surface 272, respectively. The holes 274 communicate to the recess 270.

The moving part 30 includes two moving elements 31. Each moving element 31 includes a shoulder 32, a wing 33 connecting to an outer end of the shoulder 32, and a catch 34 extending upwardly from an inner, top end of the shoulder 32. The shoulder 32 has an L-like shape. The catch 34 includes a hook extending outwardly. In the present embodiment, the shoulder 32 defines a slot 326 near the wing 33.

The cover 40 matches with the holder body 20 to cooperatively define a space for receiving the moving part 30. The cover 40 includes two pins 41 each having threads in an inner surface thereof. Two screws 50 are brought to extend through the holes 29 and the slots 33 to threadedly engage in the pins 41 thereby securely connecting the holder body 20 and the cover 40 together. The moving part 30 is received in the space defined between the cover 40 and the holder body 20.

In assembly of the lamp holder 100, the shoulders 32 of the moving part 30 are received in the guide way 28 and the recess 270; therefore, the wings 33 are exposed at two ends of the guide way 28, respectively. The catches 34 are exposed in the first groove 25 and the second groove 26 via the two holes 274 of the projection 27, respectively. When the wings 33 are pressed toward each other, the catches 34 are forced to move from the first groove 25 and the second groove 26 to enter the recess 270 of the projection 27. In the present embodiment, the moving part 30 includes a spring 36 arranged between the moving elements 31 to provide an elastic force to hold the catches 34 in the first groove 25 and the second groove 26 when there is no external pressing force acting on the wings 33. The cover 40 matches with the holder body 20 to receive the moving part 30. The screws 50 extend through the holes 29 of the holder body 20 and the slots 33 of the moving elements 31, and engage in the pins 41 of the cover 40, respectively; therefore, the moving elements 31 of the moving part 30 are sandwiched between the holder body 20 and the cover 40, and can slide relative to the holder body 20 and the cover 40, along a direction toward each other or away from each other.

Figure 5:
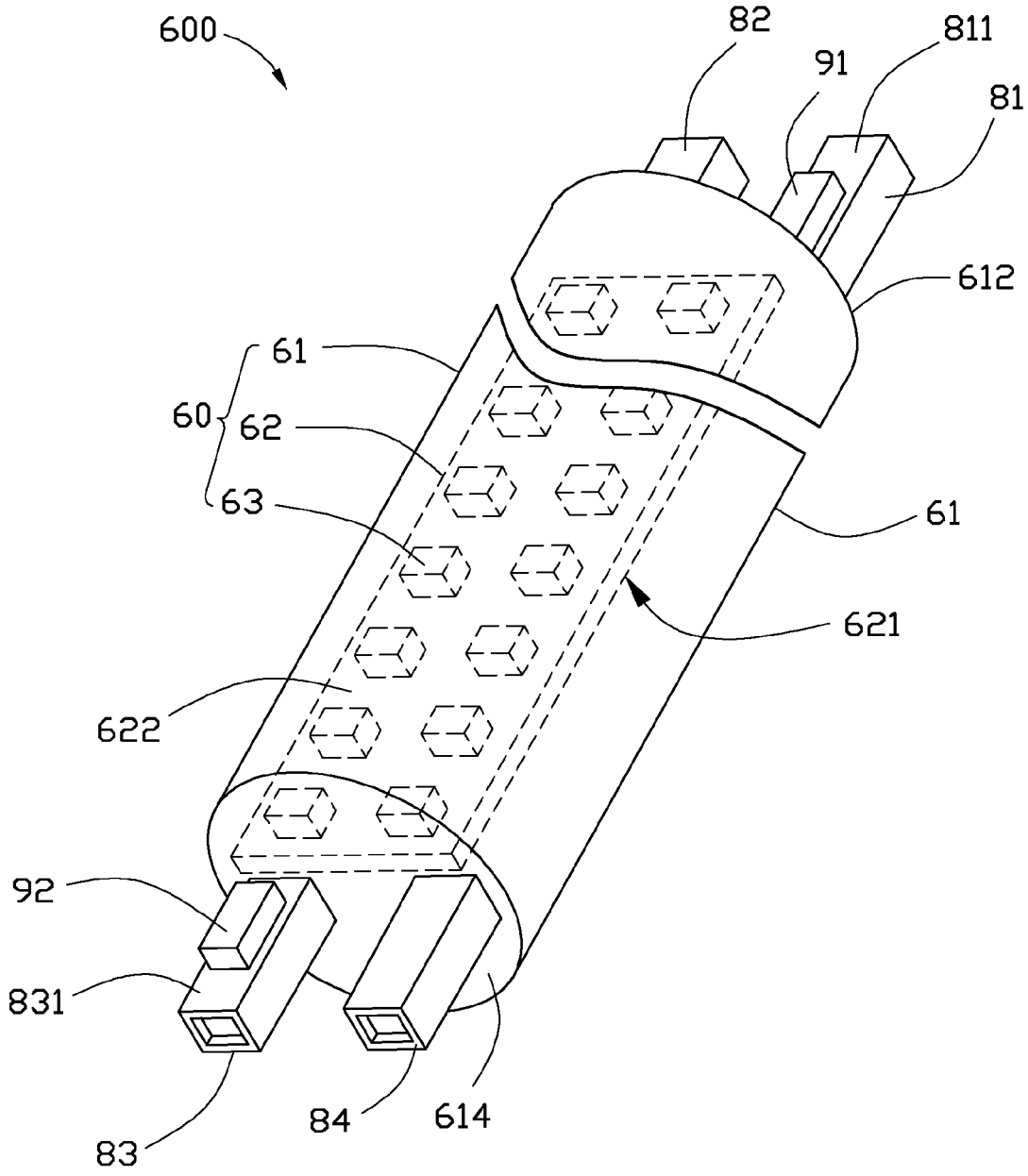
FIG. 5 is an assembled view of a lamp which is to be supported by the lamp holder of FIG. 1.

Referring to FIG. 5, a lamp 600 secured by the lamp holder 100, includes a lamp body 60, a first connector 81, a second connector 82, a third connector 83, and a fourth connector 84.

The lamp 600 has a tubular shape. The lamp 600 includes a shell 61, a substrate 62 and a plurality of LEDs 63 arranged at the substrate 62. The substrate 62 includes a third surface 621 and a fourth surface 622 opposite to the third surface 621. The LEDs 63 are arranged at the third surface 621 of the substrate 62; therefore, the third surface 621 of the substrate 62 is as the light emitting surface of the lamp 600. The shell 61 includes a first end portion 612 and a second end portion 614 opposite to the first end portion 612. In the present embodiment, the shell 61 is made of light transmissive material, such as resin, glass et al.

The first connector 81 and the second connector 82 have different polarities, which are arranged at the first end portion 612 of the substrate 62. The third connector 83 and the fourth connector 84 have different polarities, which are arranged at the second end portion 614 of the substrate 62. The first connector 81 and the third connector 83 have the same polarity (i.e., positive electricity), which are arranged at opposite sides of the shell 61. The second connector 82 and the fourth connector 84 have the same polarity (i.e., negative electricity), which are arranged at opposite sides of the shell 61. The first connector 81 and the third connector 83 are diagonally opposite to each other, and the second connector 82 and the fourth connector 84 are diagonally opposite to each other.

The first connector 81 has a first up-surface 811. The third connector 83 has a second up-surface 831. In the present embodiment, the first up-surface 811 and the second up-surface 831 are arranged at the same face as the fourth surface 622 of the substrate 62. The lamp 600 has a fool-proofing device thereon. In the present embodiment, the fool-proofing device includes a first protrusion 91 and a second protrusion 92. The first protrusion 91 and the second protrusion 92 are rectangle. In the present embodiment, the first protrusion 91 is arranged on the first up-surface 811 of the first connector 81, and the second protrusion 92 is arranged on the second up-surface 831 of the third connector 83. The first protrusion 91 and the second protrusion 92 match with the fool-proofing members 253 of the lamp holder 100.

Figure 6:
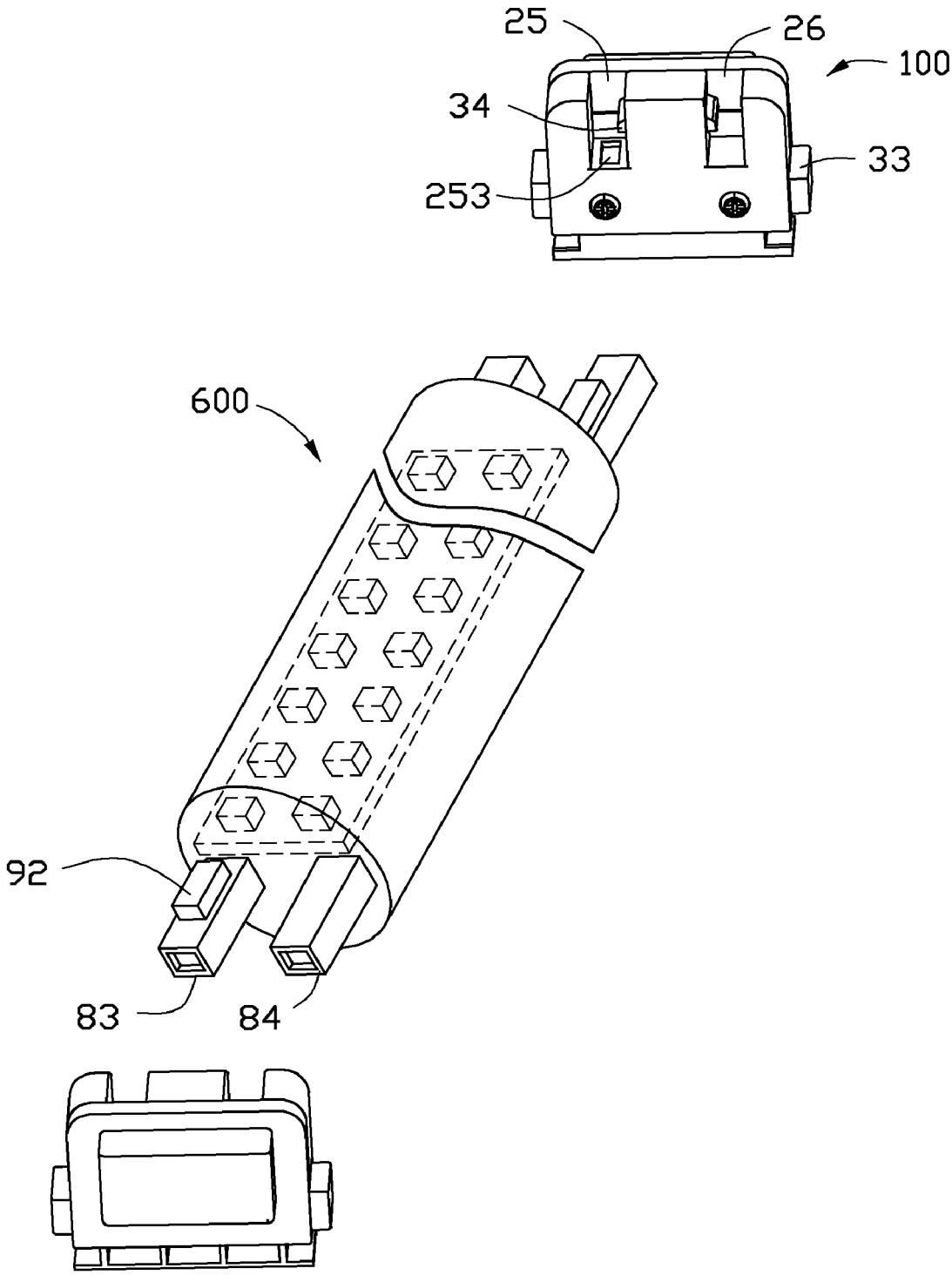
FIG. 6 is an exploded view showing the lamp in FIG. 5 with a pair of the lamp holders of FIG. 3.

Referring to FIG. 6, the lamp holder 100 is configured for securing the lamp 600. In the present embodiment, the third connector 83 and the fourth connector 84 of the lamp 600 are aligned with the first groove 25 and the second groove 26 of lamp holder 100. In the present embodiment, the third connector 83 and the fourth connector 84 are brought to enter the first and second grooves 25, 26 from top ends thereof; the third and fourth connectors 83, 84 are brought to move downwardly until the third connector 83 is entirely received in the first groove 25, and the fourth connector 84 is entirely received in the second groove 26. The second protrusion 92 of the lamp 600 is received in the fool-proofing member 253 of the lamp holder 100. During the movement of the third and fourth connectors 83, 84, the moving elements 31 are first moved away from each other by an action of the connector 83 (84) on the corresponding catch 34; then the moving elements 34 move toward each other to have the catches 34 thereof lock the third and fourth connectors 83, 84 at position when the third and fourth connectors 83, 84 reach bottoms of the first and second grooves 25, 26.

In the present embodiment, the lamp holder 100 includes the fool-proofing member 253, and the lamp 600 includes the first, second protrusion 91, 92 one of which matches with the fool-proofing member 253. Furthermore, the first protrusion 91 and the second protrusion 92 are centrally symmetric with each other about a center of the lamp 600; thus, the provision of the first and second protrusions 91, 92, and the fool-proofing members 253 ensure that the connectors 81, 82, 83, 84 are properly inserted into the lamp holder 100 which has the first grooves 25 defining the fool-proofing members 253 to receive the first and second protrusions 91, 92.

Furthermore, the lamp 600 can work normally either when the lamp 600 is mounted to the lamp holder 100 in an orientation as shown in FIG. 6 (i.e., first orientation) or in a reversed manner wherein the lamp 600 is horizontally rotated for 180 degrees so that the connectors 83, 84 are located at the right side of FIG. 6 (i.e., second orientation). Two independent driving circuits (not shown) are provided in the lamp 600 and connected with the LEDs 63 and the connectors 81, 82, 83, 84, whereby the lamp 600 can work normally either in the first orientation or in the second orientation.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A lamp holder comprising:

a holder body, the holder body comprising a first surface, a second surface opposite to the first surface, and a first side surface and a second side surface arranged between the first surface and the second surface, the holder body defining a first groove and a second groove recessed downwardly from the first side surface of the holder body, the first groove and the second groove communicating with the first and second surfaces of the holder body and configured for receiving connectors of a lamp, a fool-proofing member being arranged at a first bottom surface of the first groove to ensure that the connectors of the lamp are correctly inserted into the first and second grooves.

2. The lamp holder of claim 1, wherein the fool-proofing member is a through hole.

3. The lamp holder of claim 1, wherein the holder body further defines a guide way at the second surface thereon, the guide way being extends to the first side surface of the holder.

4. The lamp holder of claim 3, wherein the guide way communicates with the first bottom surface of the first groove.

5. The lamp holder of claim 3, wherein the fool-proofing member is a through hole, and the guide way communicates with the first bottom surface of the first groove via the through hole.

6. The lamp holder of claim 1, further comprising a moving part, and the moving part comprising two moving elements, the moving part engaging with the connectors to secure the lamp to the lamp holder.

7. The lamp holder of claim 6, wherein each moving element includes a shoulder, a wing connected to an end portion of the shoulder, and a catch connected to another end portion of the shoulder.

8. The lamp holder of claim 6, wherein the moving part further comprises a spring arranged between the moving elements.

9. The lamp holder of claim 6, further comprising a cover matching with the holder body to receive the moving part.

10. The lamp holder of claim 1, wherein the holder body defines a projection between the first groove and the second groove, the projection defines a recess at the second surface of the holder body, the holder body defining a guide way at the second surface, the guide way being extended to the first surface, the recess being communicated with the guide way.

11. The lamp holder of claim 10, wherein the projection defines through holes at side surfaces thereof, the through holes being communicated with the first groove and the second groove, respectively, each of the moving elements having a catch which is extended through a corresponding through hole into a corresponding one of the first and second grooves.

12. A lamp holder comprising:

a holder body, the holder body defining a first groove and a second groove at a first side surface of the holder body for receiving connectors of a lamp, a fool-proofing member being arranged at a bottom surface of the first groove for engaging one connector of the lamp;

two moving elements engaging in the holder body, each of the moving elements comprising a shoulder moveably received in the holder body and a catch extending from the shoulder, the catches of the moving elements moveably extending into the first groove and the second groove for locking with the connectors of the lamp.

13. The lamp holder of claim 12, wherein the fool-proofing member is a through hole.

14. The lamp holder of claim 12, wherein the holder body comprises a first surface, a second surface opposite to the first surface, the first side surface being arranged between the first surface and the second surface, the holder body defining a guide way at the second surface thereof, the guide way being communicating with the first bottom surface of the first groove.

15. The lamp holder of claim 12, wherein the fool-proofing member is a through hole, the guide way being communicated with the first bottom surface of the first groove via the through hole.

16. The lamp holder of claim 12, wherein the moving part further comprises a spring arranged between the moving elements.

17. The lamp holder of claim 12, further comprising a cover matching with holder body to receive the moving part.

* * * * *